US006837172B1

(12) United States Patent
Chuo

(10) Patent No.: US 6,837,172 B1
(45) Date of Patent: Jan. 4, 2005

(54) NEEDLE GUARD MECHANISM FOR SEWING MACHINES

(75) Inventor: Jui-Jung Chuo, Taipei Hsien (TW)

(73) Assignee: Shing Ray Sewing Machine Co., Ltd., Taipei Hsien (TW)

( * ) Notice: Subject to any disclaimer, the term of this patent is extended or adjusted under 35 U.S.C. 154(b) by 0 days.

(21) Appl. No.: 10/694,943

(22) Filed: Oct. 29, 2003

(51) Int. Cl.[7] ..... D05B 83/00
(52) U.S. Cl. ..... 112/261
(58) Field of Search ..... 112/227, 261, 112/184, 181; 24/706.2, 706.5

(56) References Cited

U.S. PATENT DOCUMENTS 934,954 A * 9/1909 Woodward ..... 112/227
4,285,291 A * 8/1981 Ackermann et al. ..... 112/184
4,438,717 A * 3/1984 Minella et al. ..... 112/227
4,757,774 A * 7/1988 Junemann ..... 112/181
4,791,875 A * 12/1988 Ackermann ..... 112/227
4,970,977 A * 11/1990 Motta ..... 112/227

* cited by examiner

*Primary Examiner*—Ismael Izaguirre
(74) *Attorney, Agent, or Firm*—Birch, Stewart, Kolasch & Birch, LLP

(57) ABSTRACT

A needle guard mechanism for sewing machines aims at stabilizing needles during lowering for stitching operation to prevent needle wobbling caused by high speed motion thereby to avoid the needles from breaking or skipping. The needle guard mechanism adopts an independent design to adjust needle lowering and lifting time separately. The mechanism includes a needle guard and a transmission mechanism. The needle guard consists of a movable member, a front needle guard straddled on the movable member and a rear needle guard fastened to the movable member. The transmission mechanism provides a force to drive the movable member to move reciprocally so that the front needle guard swings in the opposite direction against the reciprocal motion thereby it moves close to the rear needle guard to hold the lowering needles steadily to prevent needle wobbling.

11 Claims, 6 Drawing Sheets

NEEDLE GUARD MECHANISM FOR SEWING MACHINES

FIELD OF THE INVENTION

The present invention relates to a needle guard mechanism for sewing machines and particularly to a mechanism to stabilize stitching needles without wobbling during high speed motion.

BACKGROUND OF THE INVENTION

At present sewing technology is quite mature. Many fast speed and simple sewing machines have been developed and mass production of high quality clothes and garments at lower costs is possible to benefit people. The earlier sewing machines that employ one needle and one thread and foot driving operation have been mostly replaced by automatic operation in the plant to enhance production efficiency and reduce cost.

As industrial sewing machines are required to achieve high production efficiency, to speed up stitching operation and reduce needle breaking is necessary. Nowadays sewing machines all adopt high speed motors to speed up stitching operation. However the needle tends to wobble in the high speed motion. In the condition of the needle being lowered at high speed and needle wobbling occurs, the probability of needle breaking increases. As a result, stitching operation is often interrupted. It becomes difficult to boost production efficiency.

Refer to FIG. 1 for a needle guard mechanism in a conventional sewing machine. It includes a front needle guard 13*a* connecting to a lower needle hook 40. When the axle 41 which controls the lower needle hook 41 rotates, the needle (not shown in the drawing) is moved downwards. When the needle is to be lifted upwards, the lower needle hook 40 starts operation to thread a looping yarn (not shown in the drawing), and moves the front needle guard 13*a* close to the rear needle guard 12*a*. The rear needle guard 12*a* is connected to the cloth driving teeth 42 which is driven by a connection beam 43. Therefore the rear needle guard 12*a* is pushed close to the front needle guard 13*a* to slightly clamp the needle. As the needle guard mechanism clamps the needle when the needle starts lifting, and the front and rear needle guards 13*a* and 12*a* are driven differently by the axle 41 and the connection beam 43, it is difficult to achieve accurate timing. As a result, needle broken or needle skip often occurs.

SUMMARY OF THE INVENTION

The primary object of the invention is to provide a needle guard mechanism for sewing machines to achieve steady stitch operation. The needle guard mechanism according to the invention includes:

- a needle guard which consists of a movable member, a rear needle guard and a front needle guard. The rear needle guard is fastened to the top section of the movable member. The front needle guard straddles the top section of the movable member and is swingable reciprocally; and
- a transmission mechanism which includes an main axle, a direction switch mechanism and a linkage mechanism. The main axle provides a rotational force and is coupled with the direction switch mechanism. The direction switch mechanism transforms the rotation force of the main axle to a reciprocal movement normal to the main axle. The linkage mechanism transfers the force to the needle guard.

Another object of the invention is to provide a needle guard mechanism that is operable independently. Through the direction switch mechanism and the linkage mechanism the needle guard mechanism may be operated independently. It is different from the conventional needle guard mechanism that has the front and rear needle guard located respectively on the lower needle hook and the cloth driving teeth and driven by the axle and connection beam. Because of the independent design, the closing and separating time of the needle guard mechanism may be separately adjusted to match the needle lowering and lifting operation.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
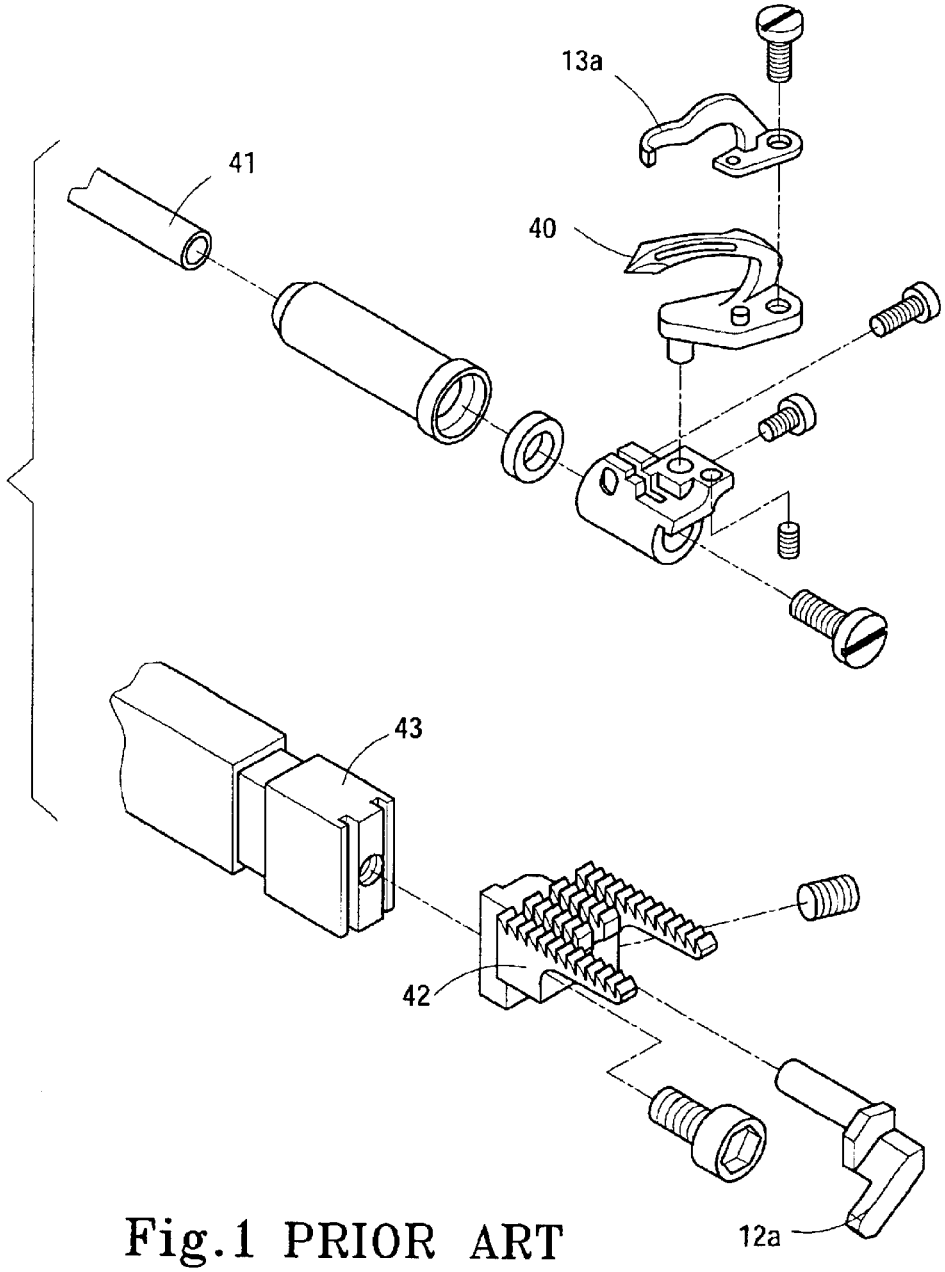
Fig.1 PRIOR ART
FIG. 1 is an exploded view of a conventional needle guard mechanism.
Figure 2:
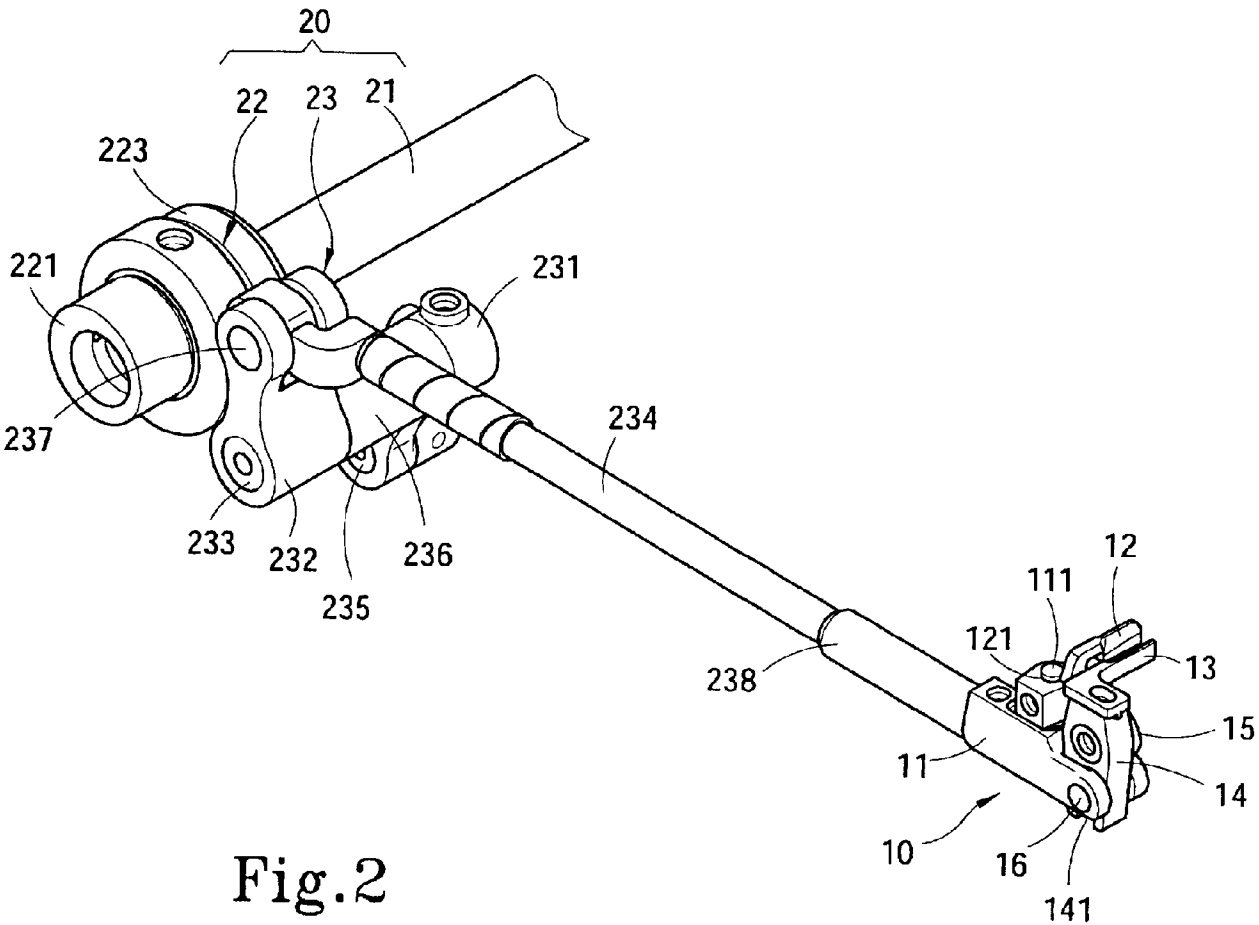
FIG. 2 is a perspective view of the present invention.
Figure 7:
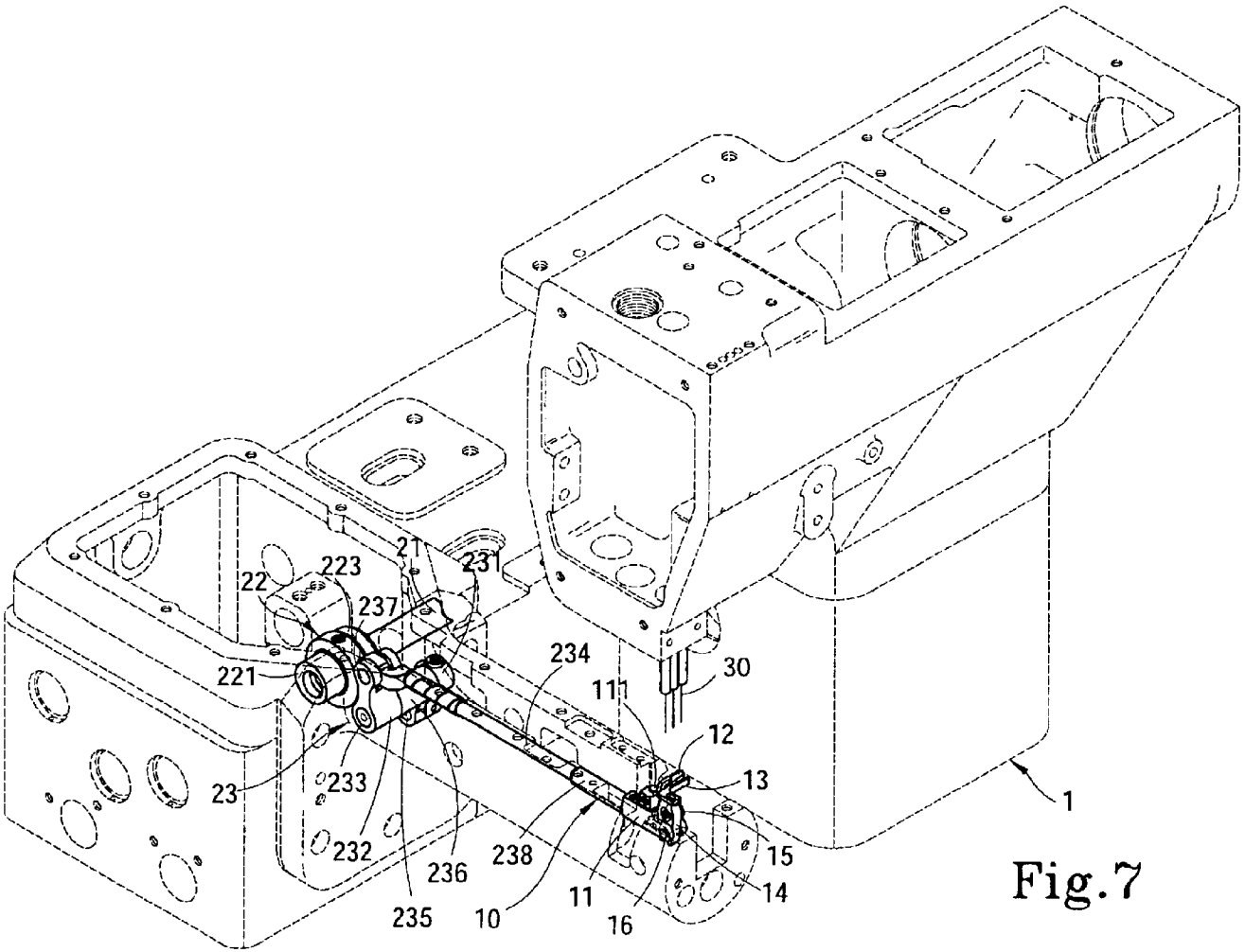
FIG. 7 is a schematic view of the invention in a use condition.

Please referring to FIGS. 2 and 7, the needle guard mechanism according to the invention is located in a sewing machine 1 to stabilize needles 30 while the needles are moved downwards to prevent the needles 30 from wobbling at high speed motion. It includes a needle guard 10 and a transmission mechanism 20. The needle guard 10 consists of a movable member 11, a rear needle guard 12 and a front needle guard 13. The rear needle guard 12 is fastened to the top section of the movable member 11. The front needle guard 13 straddles the top section of the movable member 11 and is swingable reciprocally. The transmission mechanism 20 includes a main axle 21, a direction switch mechanism 22 and a linkage mechanism 23. The main axle 21 provides a rotational force and is coupled to the direction switch mechanism 22. The direction switch mechanism 22 transforms the rotational force of the main axle 21 to a reciprocal force normal to the main axle 21. The linkage mechanism 23 transfers the force to the needle guard 10 and drives the needle guard 10 moving reciprocally.

Figure 3:
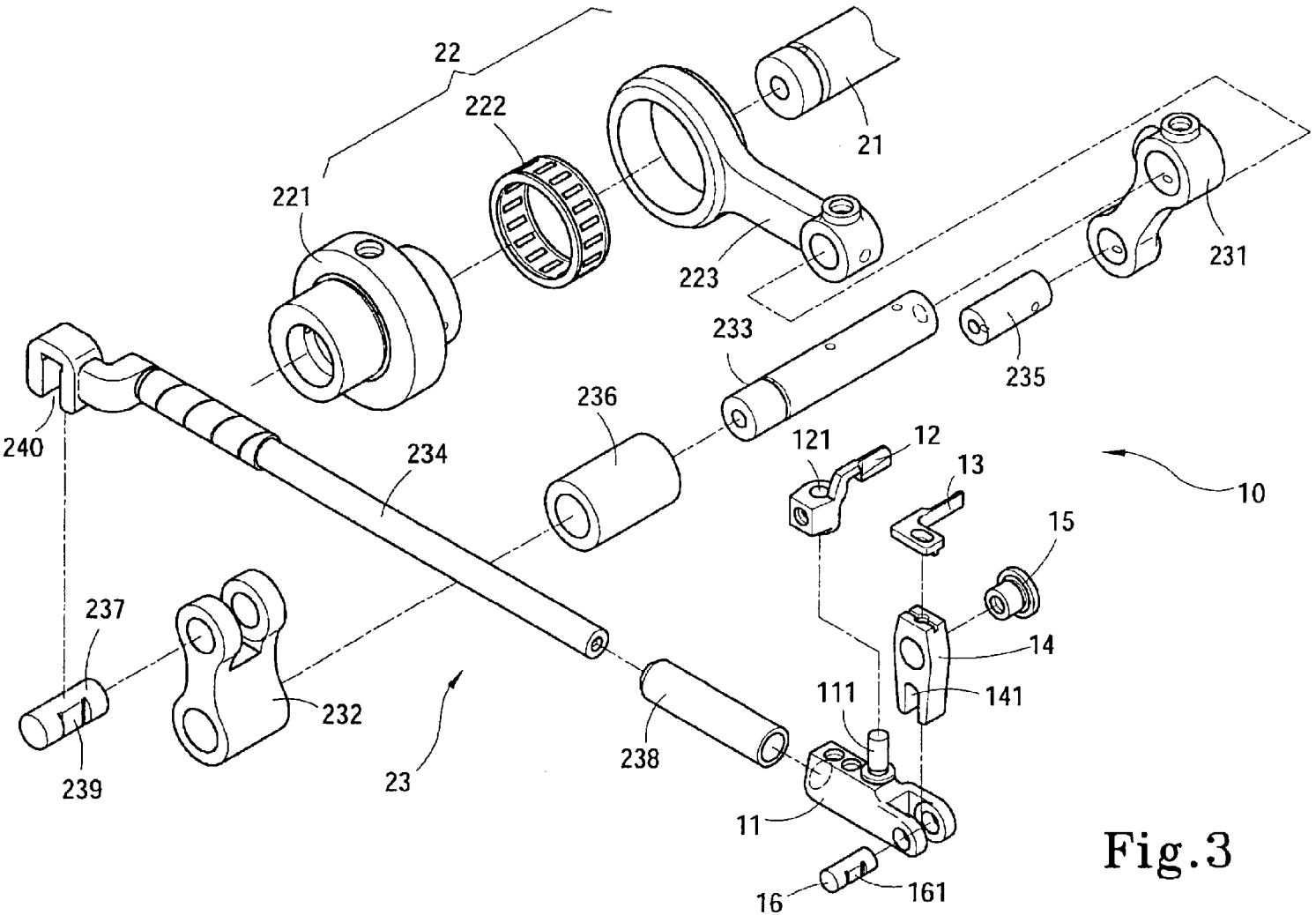
FIG. 3 is an exploded view of the present invention.
Figure 4:
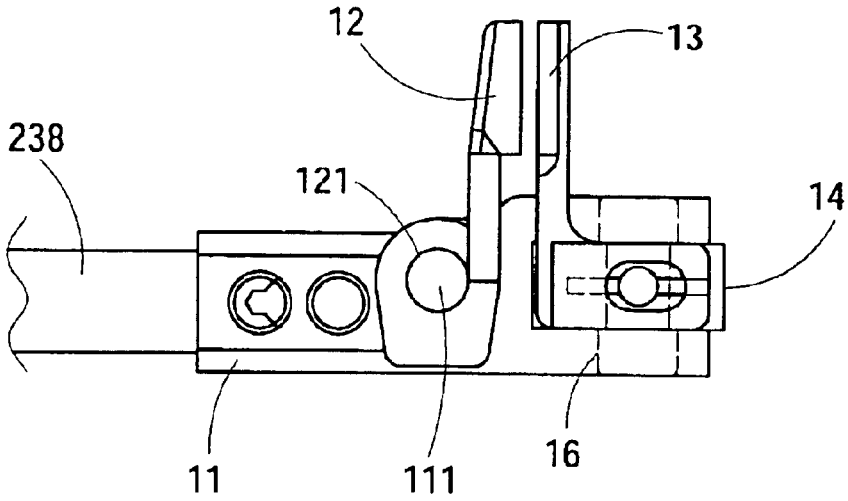
FIG. 4 is a top view of the present invention.
Figure 5:
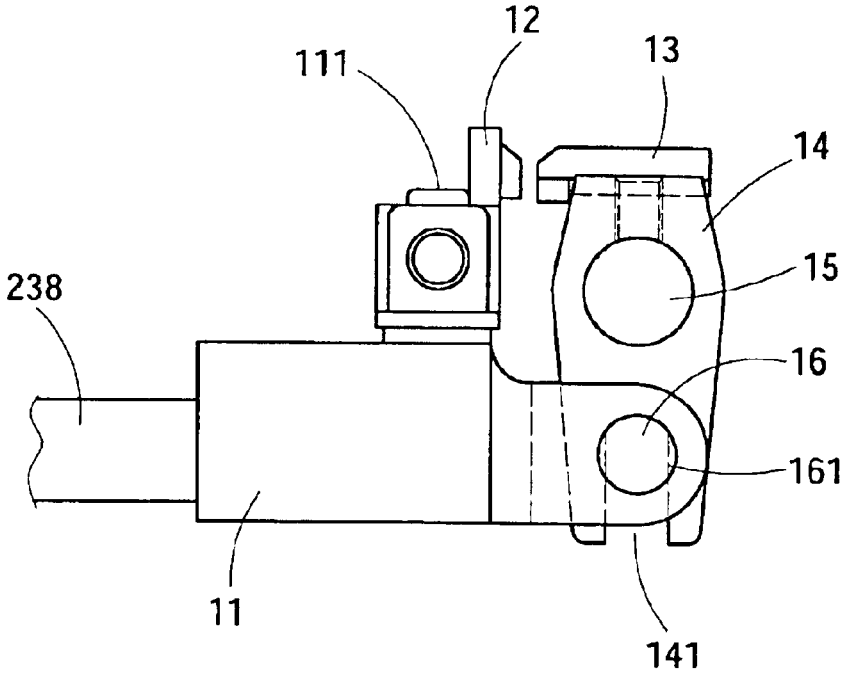
FIG. 5 is a front view of the present invention.

Referring to FIGS. 3, 4 and 5, the direction switch mechanism 22 of the transmission mechanism 20 (also shown in FIG. 2) consists of a cam 221, a bearing 222 and an oscillation member 223. The cam 221 has one end coupled with the bearing 222 and connected to the oscillation member 223. The main axle 21 runs through the cam 221, bearing 222 and oscillation member 223. The linkage mechanism 23 of the transmission mechanism 20 includes a first oscillation element 231, a first shaft 233, a second oscillation element 232, a second shaft 234, and three coupling sleeves 235, 236 and 238. The first oscillation element 231 has one end coupling with the oscillation member 223 and another end coupling with the first shaft 233. The first shaft 233 and the oscillation member 223 are interposed by the coupling sleeve 235. The first shaft 233 has another end coupling with one end of the second oscillation element 232, and they are interposed by the coupling sleeve 236. The second oscillation element 232 has another end coupling with one end of the second shaft 234 through a first connection member 237. The first connection member 237 has a first latch section 239 on a lateral side that is formed in a flatten recess to couple with a first straddle section 240 of the second shaft 234. Finally, the second shaft 234 has another end running through the coupling sleeve 238 to couple with the needle guard 10. The movable member 11 of the needle guard 10 has a strut 111 to couple with an aperture 121 formed on the rear needle guard 12. The front needle guard element 13 has one end coupling with a coupling member 14 through a fastening element 15 which is fastened to the sewing machine 1 (also referring to FIG. 7). The coupling member 14 has another end forming a second straddle section 141. The coupling member 14 is coupled with the movable member 11 through a second connection member 16. The second connection member 16 has a second latch section 161 formed on a lateral side to couple with the second straddle section 141 so that the coupling member 14 of the front needle guard 13 is coupled with the movable member 11.

Figure 6A:
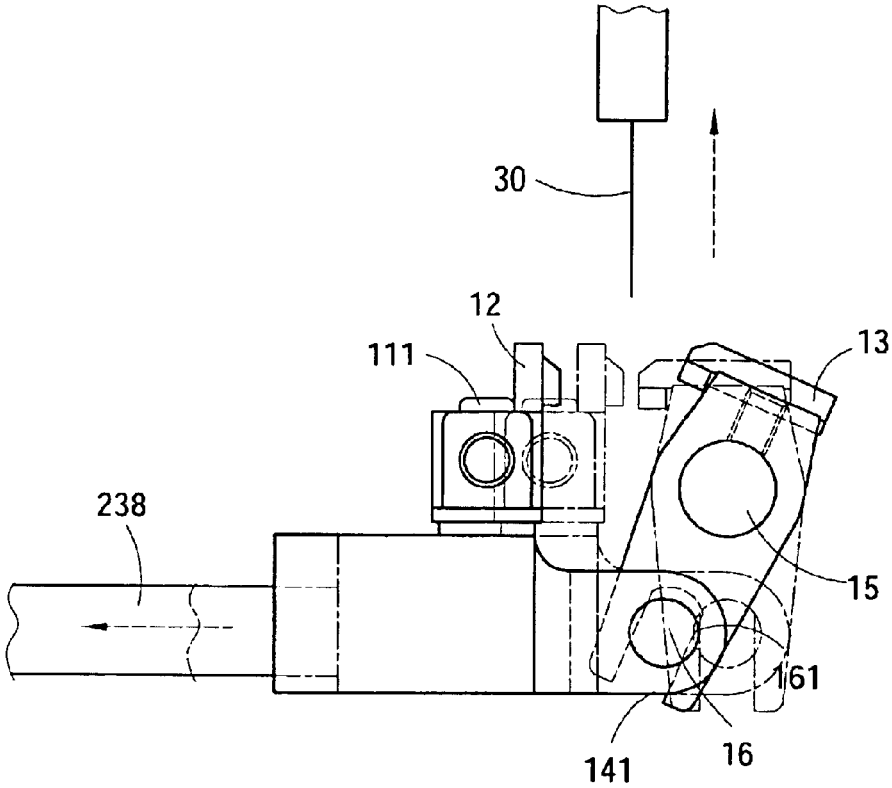
FIG. 6A is a front view of the needle guard mechanism in an operating condition.
Figure 6B:
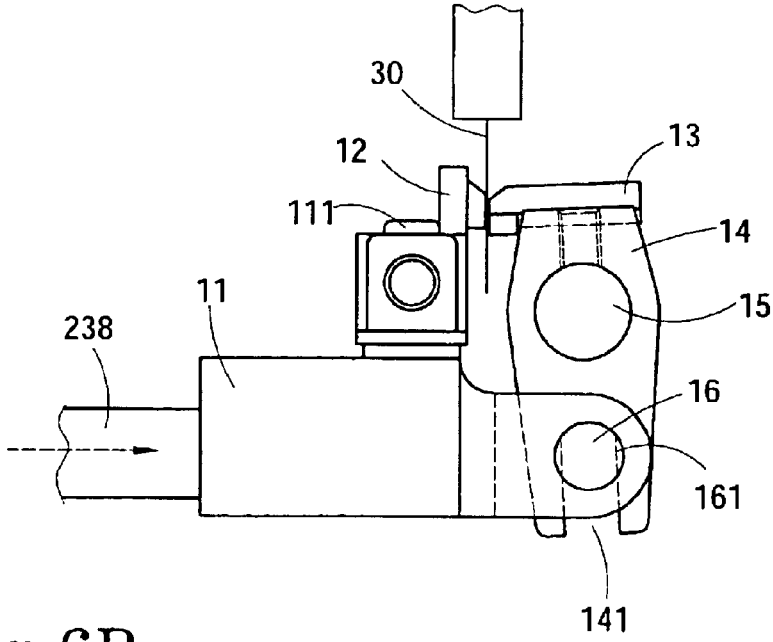
FIG. 6B is a front view of the needle guard mechanism in another operating condition.

Referring to FIGS. 3, 6A and 6B, when the main axle 21 rotates, the cam 221 is driven to rotate. As the bearing 222 is located in the oscillation member 223, the oscillation member 223 does not rotate. Instead, it is driven by the cam 221 to move reciprocally in the horizontal direction. When the needles 30 are moved downwards for stitching, the oscillation member 223 is moved rearwards. Meanwhile the first oscillation element 231 rotates counterclockwise and drives the first shaft 233 to move forwards, and the second oscillation member 232 also rotates counterclockwise and drives the second shaft 234 rearwards. In the mean time, the movable member 11 of the needle guard 10 is moved rearwards, and the coupling member 14 swings forwards due to the opposite reaction force. Thus the front and rear needle guards 13 and 12 are separated from each other. When the oscillation member 223 moves forwards, the first oscillation element 231 rotates clockwise and drives the first shaft 233 moving rearwards, and the second oscillation element 232 swings clockwise, which in turn drives the second shaft 234 moving forwards. Meanwhile, the movable member 11 of the needle guard 10 moves forwards, and the coupling member 14 is pushed and swings counterclockwise. Hence the front and rear needle guards 13 and 12 are moved close to each other. When the needles 30 are lowered for stitching, the closing front and rear needle guards 13 and 12 slightly clamp the moving needles 30 to form a steady condition without wobbling. When the needles 30 are lifted upwards, the front and rear needle guards 13 and 12 are separated from each other.

What is claimed is:

1. A needle guard mechanism for sewing machines to stabilize needles during lowering for stitching operation to prevent wobbling caused by high speed motion, comprising:

a needle guard including a movable member, a rear needle guard fastening to a top section of said movable member and a front needle guard straddling the top section of said movable member and swingable reciprocally; and a transmission mechanism including an main axle, a direction switch mechanism and a linkage mechanism, said main axle providing a rotational force and being coupled with said direction switch mechanism, said direction switch mechanism transforming the rotational force to a reciprocal movement normal to said main axle, said linkage mechanism transferring the force to said needle guard.

2. The needle guard mechanism of claim 1, wherein said direction switch mechanism includes an cam, a bearing and an oscillation member, said cam having one end coupled with said bearing and said oscillation member to drive said oscillation member to move reciprocally for moving said needle guard through said linkage mechanism.

3. The needle guard mechanism of claim 1, wherein said linkage mechanism includes at least one oscillation element and one shaft that are coupled with each other to drive said needle guard to move.

4. The needle guard mechanism of claim 1, wherein said linkage mechanism includes a first oscillation element, a second oscillation element, a first shaft, a second shaft and three coupling sleeves that are inter-coupled with one another, said first oscillation element being coupled with said transmission mechanism, said second shaft being coupled with said needle guard.

5. The needle guard mechanism of claim 4, wherein said second oscillation element is coupled with said second shaft through a first connection member such that said second oscillation element and said second shaft are swingable relative to each other.

6. The needle guard mechanism of claim 5, wherein said first connection member has a first latch section on a lateral side thereof.

7. The needle guard mechanism of claim 5, wherein said second shaft has one end forming a first straddle section to couple with said first connection member.

8. The needle guard mechanism of claim 1, wherein said movable member of said needle guard is coupled with said front needle guard through a coupling member.

9. The needle guard mechanism of claim 8, wherein said movable member of said needle guard is coupled with said coupling member through a second connection member such that said movable member and said coupling member are swingable relative to each other.

10. The needle guard mechanism of claim 9, wherein said second connection member has a second latch section on a lateral side thereof.

11. The needle guard mechanism of claim 10, wherein said coupling member has a second straddle section on one end which couples with said movable member of said needle guard so that said second straddle section is coupled with said second latch section to couple said movable member with said coupling member.

* * * * *